US010072614B2

(12) United States Patent
Xue

(10) Patent No.: US 10,072,614 B2
(45) Date of Patent: Sep. 11, 2018

(54) ANTI-ADJUSTING ROTARY VALVE TYPE CARBURETOR

(71) Applicant: Meiying Xue, Zhejiang (CN)

(72) Inventor: Meiying Xue, Zhejiang (CN)

( * ) Notice: Subject to any disclaimer, the term of this patent is extended or adjusted under 35 U.S.C. 154(b) by 71 days.

(21) Appl. No.: 15/281,706

(22) Filed: Sep. 30, 2016

(65) Prior Publication Data

US 2017/0122263 A1 May 4, 2017

(30) Foreign Application Priority Data

Nov. 2, 2015 (CN) ..... 2015 2 0863759 U

(51) Int. Cl.
*F02M 19/04* (2006.01)
*F02M 7/06* (2006.01)
(Continued)

(52) U.S. Cl.
CPC ..... *F02M 3/10* (2013.01); *B25B 13/50* (2013.01); *F02M 7/06* (2013.01); *F02M 9/08* (2013.01); *F02M 19/04* (2013.01)

(58) Field of Classification Search
CPC .. F02M 3/10; F02M 7/06; F02M 9/08; F02M 19/04
(Continued)

(56) References Cited

U.S. PATENT DOCUMENTS 5,709,822 A 1/1998 Togashi
6,394,424 B2 5/2002 Pattullo et al.
(Continued)

FOREIGN PATENT DOCUMENTS

JP H11324801 A 11/1999
JP 2003176755 A 6/2003
(Continued)

OTHER PUBLICATIONS

English language abstract for JP H11324801 A (1999).
(Continued)

*Primary Examiner* — Robert A Hopkins
(74) *Attorney, Agent, or Firm* — Caesar Rivise, PC

(57) ABSTRACT

This invention relates to an anti-adjusting butterfly valve type carburetor, comprising a kind of high speed adjustment oil needle having eccentric hole and a kind of idle adjustment oil needle having eccentric hole, and it also correspondingly discloses a kind of specialized adjustment tool having eccentric convex platform for adjusting the high speed adjustment oil needle and the idle adjustment oil needle. The invention also discloses a kind of high speed adjustment oil needle having eccentric convex platform and a kind of idle adjustment oil needle having eccentric convex platform an it also correspondingly discloses a kind of specialized adjustment tool having eccentric hole for adjusting the high speed adjustment oil needle and the idle adjustment oil needle. Compared with the prior art, the invention has the following beneficial effects: Because the high speed adjustment oil needle and the idle speed adjustment oil needle have the anti-adjusting structure, thereby ensure that the customers can not be adjust the oil flow into the carburetor freely, and then ensure that the engine is always in optimal setting state.

31 Claims, 14 Drawing Sheets

(51) Int. Cl.

| | |
|---|---|
| ***F02M 9/08*** | (2006.01) |
| ***F02M 3/10*** | (2006.01) |
| ***B25B 13/50*** | (2006.01) |

(58) Field of Classification Search
USPC ..... 261/35, 44.6, 44.8, 69.1, DIG. 38
See application file for complete search history.

(56) References Cited

U.S. PATENT DOCUMENTS

| | | | | |
|---|---|---|---|---|
| 7,290,757 | B2 * | 11/2007 | Horikawa ..... | F02M 9/08<br>261/44.6 |
| 8,608,136 | B2 | 12/2013 | Saito | |
| 9,856,827 | B2 * | 1/2018 | Xue ..... | F02M 3/10 |

FOREIGN PATENT DOCUMENTS

| | | | |
|---|---|---|---|
| JP | 2005120843 | A | 5/2005 |
| JP | 2007077812 | A | 3/2007 |

OTHER PUBLICATIONS

English language abstract for JP 2003176755 A (2003).
English language abstract for JP 2005120843 A (2005).
English language abstract for JP 2007077812 A (2007).

* cited by examiner

ANTI-ADJUSTING ROTARY VALVE TYPE CARBURETOR

FIELD OF THE INVENTION

This invention relates to carburetors and specialized adjustment tool thereof, more particularly to anti-adjusting butterfly valve type carburetors and specialized adjustment tool thereof.

BACKGROUND OF THE INVENTION

The carburetor is vacuum produced in the engine work, the gasoline can be mixed with air for a certain proportion. The carburetor as a precision device, it plays an important role in the engine and can be called the "heart of the engine". The device should includes starting device, idle device and throttle control device. According to the requirements of the different work state for engine, carburetor automatically matches the corresponding mixed gas concentration, outputs the corresponding amount of mixed gas, in order to make the distribution of the mixed gas mixed evenly, the carburetor has the effect of fuel atomization, for the normal operation of the machine.

In order to make the carburetor to be always work stably in the optimum mixture ratio of the fuel and air, usually carburetor manufacturers in the carburetor factory had the carburetor fuel and air mixing ratio adjusted to the optimal state, which can not only play the best working performance of the engine, and significantly extend the carburetor normal working life, but also make the carburetor to reach optimal oil state at work, thus greatly saving fuel resources. In order to enable the carburetor to be stable in the optimum mixture ratio of the fuel and air and play the optimal performance of engine, and also to substantially extend the carburetor normal service life and save fuel resources, it is necessary to set up anti-adjusting mechanism on the carburetor to prevent non-specialized users from randomly adjusting the fuel and air mixing proportion of the carburetor. However, the existing carburetor cannot meet the above requirements. For example, U.S. Pat. No. 6,394,424 discloses a rotary valve carburetor, including: The structure of the regulating head of the idle adjustment oil needle is linear type, and a steel ball is pressed on the top of the regulation structure, this anti-adjusting structure is very complex, economic performance is very poor, and engine manufacturers or carburetor manufacturers will not be able to adjust the idle oil needle when they need to adjust the carburetor technical parameters.

SUMMARY OF THE INVENTION

In order to solve the technical defects of the existing carburetor and a specialized adjustment tool, the invention has the technical proposal adopted as following:

An anti-adjusting butterfly valve type carburetor, comprising a body, the body is provided with a high speed adjustment oil needle mounting hole, a high speed adjustment oil needle having eccentric hole is installed inside the high speed adjustment oil needle mounting hole of the body, the high speed adjustment oil needle having eccentric hole comprising a head of the high speed adjustment oil needle, the end face of the head of the high speed adjustment oil needle is provided with a first eccentric hole.

An anti-adjusting butterfly valve type carburetor, comprising a body, the body is provided with an idle adjustment oil needle mounting hole, an idle adjustment oil needle having eccentric hole is installed inside the idle adjustment oil needle mounting hole of the body, the idle adjustment oil needle having eccentric hole comprising a head of the idle adjustment oil needle, the end face of the head of the idle adjustment oil needle is provided with a second eccentric hole.

A specialized adjustment tool having eccentric convex platform, comprising a handle and a head, the front face of the head is provided with a counterbore, the bottom surface of the counterbore is provided with an eccentric convex platform.

An anti-adjusting butterfly valve type carburetor, comprising a body, the body is provided with a high speed adjustment oil needle mounting hole, a high speed adjustment oil needle having eccentric convex platform is installed inside the high speed adjustment oil needle mounting hole of the body, the high speed adjustment oil needle having eccentric convex platform comprising a head of the high speed adjustment oil needle, the head of the high speed adjustment oil needle is provided with a first eccentric convex platform.

An anti-adjusting butterfly valve type carburetor, comprising a body, the body is provided with a idle adjustment oil needle mounting hole, an idle adjustment oil needle having eccentric convex platform is installed inside the idle adjustment oil needle mounting hole of the body, the idle adjustment oil needle having eccentric convex platform comprising a head of the idle adjustment oil needle, the head of the idle adjustment oil needle is provided with a second eccentric convex platform.

A specialized adjustment tool having eccentric hole, comprising a handle and a head, the front face of the head is provided with a concentric blind hole, the bottom surface of the concentric blind hole is provided with an eccentric counterbore.

Preferably, the body is provided with an air intake passage, an air and fuel mixing passage and an outlet of the air and fuel mixing passage.

In any of the above schemes, preferably, the front end of the mounting hole for the high speed adjustment oil needle is provided with a recess of the body, the head of the high speed adjustment oil needle is installed in the recess of the body, in order to prevent the customer to adjust the adjustment oil needle freely.

In any of the above schemes, preferably, the front end of the mounting hole for the idle adjustment oil needle is provided with a recess of the body, the head of the idle adjustment oil needle is installed in the recess of the body, in order to prevent the customer to adjust the adjustment oil needle freely.

In any of the above schemes, preferably, a pump cover is installed on the upper part of the body, the fuel pump diaphragm is installed between the fitting surface of the body and the fitting surface of the pump cover.

In any of the above schemes, preferably, the lower end face of the pump cover is provided with a first recess, a fuel chamber is formed by a cavity enclosed by the first recess and the fuel pump diaphragm, the upper end face of the body is provided with a second recess, a pressure pulse chamber is formed by a cavity enclosed by the second recess and the fuel pump diaphragm, the body is also provided with a pressure pulse passage, the pressure pulse passage is communicated with the pressure pulse chamber.

In any of the above schemes, preferably, the mounting hole for the high speed adjustment oil needle extends from recess of the body toward inside of the body and it is also successively provided with a first internal thread of the body, a seal sleeve mounting hole for the high speed adjustment oil needle, an oil passage cavity for the high speed adjustment oil needle and an outlet of the oil passage hole for the high speed adjustment oil needle.

In any of the above schemes, preferably, the body is provided with a fuel inlet, the fuel inlet is communicated with the outlet of the oil passage hole for the high speed adjustment oil needle.

In any of the above schemes, preferably, the mounting hole for the idle adjustment oil needle extends from the recess of the body toward inside of the body and it is also successively provided with a second internal thread of the body, a seal sleeve mounting hole for the idle adjustment oil needle, an oil passage cavity for the idle adjustment oil needle and an outlet of the oil passage hole for the idle adjustment oil needle.

In any of the above schemes, preferably, the high speed adjustment oil needle having eccentric hole extends from a side of the head of the high speed adjustment oil needle and it is also successively provided with locking portion of the high speed adjustment oil needle, threaded portion of the high speed adjustment oil needle, a first polished rod portion of the high speed adjustment oil needle and tip portion of the high speed adjustment oil needle, the head of the high speed adjustment oil needle is provided with a second polished rod portion of the high speed adjustment oil needle.

In any of the above schemes, preferably, the shape of the tip portion of the high speed adjustment oil needle is conical.

In any of the above schemes, preferably, the idle adjustment oil needle having eccentric hole extends from a side of the head of the idle adjustment oil needle and it is also successively provided with locking portion of the idle adjustment oil needle, threaded portion of the idle adjustment oil needle, a first polished rod portion of the idle adjustment oil needle and tip portion of the idle adjustment oil needle, the head of the idle adjustment oil needle is provided with a second polished rod portion of the idle adjustment oil needle. The shape of the tip portion of the idle adjustment oil needle is conical.

In any of the above schemes, preferably, a seal sleeve for the high speed adjustment oil needle is installed inside the seal sleeve mounting hole for the high speed adjustment oil needle.

In any of the above schemes, preferably, the seal sleeve for the high speed adjustment oil needle is provided with a polished rod portion of the seal sleeve and an inner hole.

In any of the above schemes, preferably, a seal sleeve for the idle adjustment oil needle is installed inside the seal sleeve mounting hole for the idle adjustment oil needle.

In any of the above schemes, preferably, the seal sleeve for the idle adjustment oil needle is provided with a polished rod portion of the seal sleeve and an inner hole.

In any of the above schemes, preferably, the head is provided with polished rod portion.

In any of the above schemes, preferably, the high speed adjustment oil needle having eccentric convex platform extends from a side of the head of the high speed adjustment oil needle and it is also successively provided with locking portion of the high speed adjustment oil needle, threaded portion of the high speed adjustment oil needle, a first polished rod portion of the high speed adjustment oil needle and tip portion of the high speed adjustment oil needle, the head of the high speed adjustment oil needle is provided with a second polished rod portion of the high speed adjustment oil needle. The shape of the tip portion of the high speed adjustment oil needle is conical.

In any of the above schemes, preferably, the idle adjustment oil needle having eccentric convex platform extends from a side of the head of the idle adjustment oil needle and it is also successively provided with locking portion of the idle adjustment oil needle, threaded portion of the idle adjustment oil needle, a first polished rod portion of the idle adjustment oil needle and tip portion of the idle adjustment oil needle, the head of the idle adjustment oil needle is provided with a second polished rod portion of the idle adjustment oil needle. The shape of the tip portion of the idle speed adjustment oil needle is conical.

Comparing with the prior art, the invention has the beneficial effects as following: on the one hand, the high speed adjustment oil needle having eccentric hole and the idle adjustment oil needle having eccentric hole are all provided with threaded portion, the head of the high speed adjustment oil needle and the head of the idle adjustment oil needle are all provided with eccentric hole. We must use the specialized adjustment tool having eccentric convex platform to adjust the high speed adjustment oil needle having eccentric hole and the idle adjustment oil needle having eccentric hole when we need. When adjusted, the adjusting oil needle can move along the axis of the threaded portion, for regulating the flow of oil into the carburetor. Because clients usually have no specialized adjustment tool having eccentric convex platform, so they can not be adjusted freely into the carburetor oil flow, thus ensures that the engine is always in optimal set state, and to ensures that the exhaust gas discharged by the engine to meet the requirements of environmental protection. On the other hand, the high speed adjustment oil needle having eccentric convex platform and the idle adjustment oil needle having eccentric convex platform are all provided with threaded portion, and the head of the high speed adjustment oil needle and the head of the idle adjustment oil needle are all provided with eccentric convex platform, thus we must use the specialized adjustment tool having eccentric hole to adjust the high speed adjustment oil needle having eccentric convex platform and the idle adjustment oil needle having eccentric convex platform. When adjusted, the adjusting oil needle can move along the axis of the threaded portion, for regulating the flow of oil into the carburetor. Similarly, because customers usually have no specialized adjustment tool having eccentric hole, so they cannot be adjusted freely flow to the carburetor oil so as to ensure the engine is always in optimal set state, and to ensure that the exhaust gas discharged by the engine to meet the requirements of environmental protection.

Figure 1:
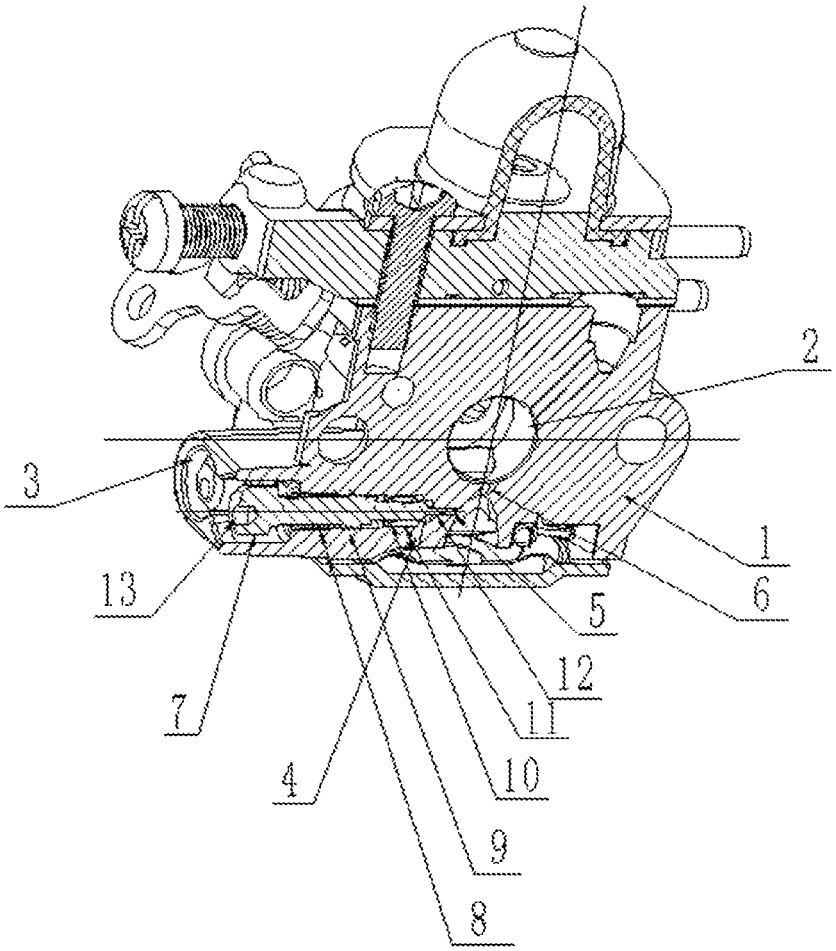
FIG. 1 is an axonometric section view of a optimal embodiment in accordance to the present invention, in which the adjustment oil needles is a high speed adjustment oil needle with eccentric hole and an idle adjustment oil needle with eccentric hole.
Figure 2:
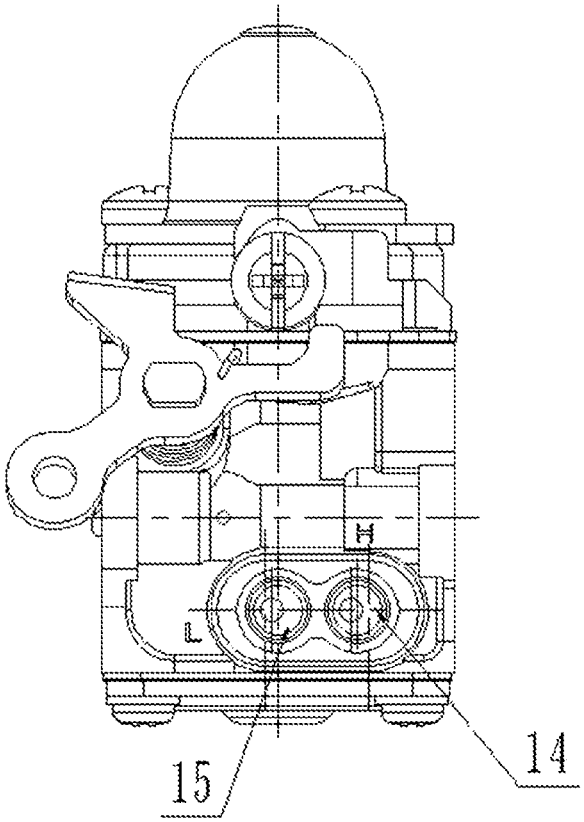
FIG. 2 is a left view of the embodiment of FIG. 1 in accordance to the present invention, in which the adjustment oil needles is a high speed adjustment oil needle with eccentric hole and an idle adjustment oil needle with eccentric hole.
Figure 3:
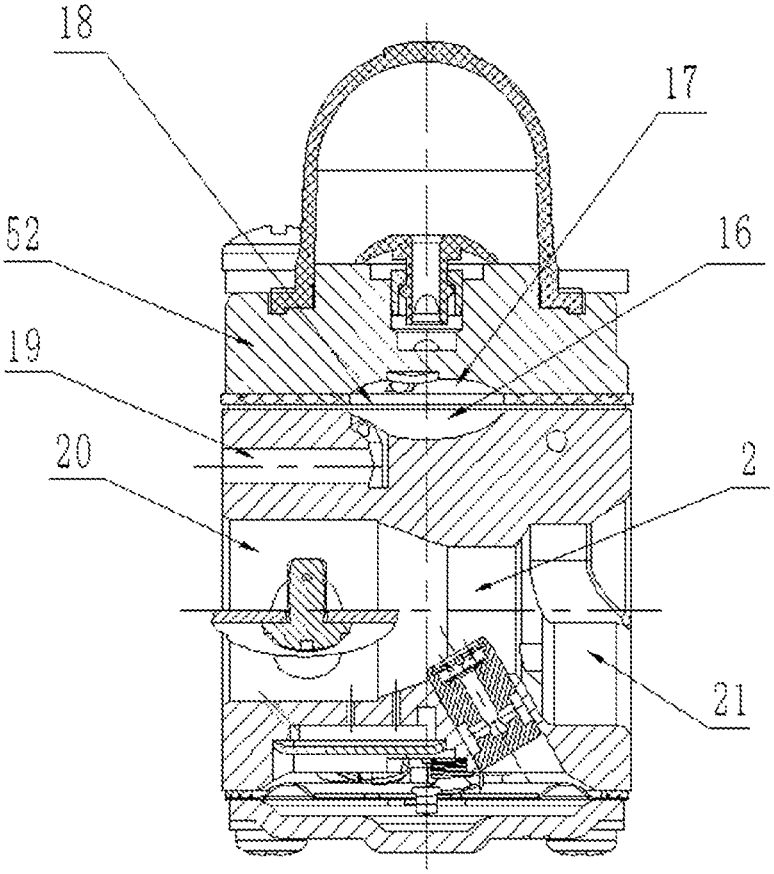
FIG. 3 is an axial section view along the center line of the air and fuel mixing passage of the embodiment of FIG. 1 in accordance to the invention.
Figure 4:
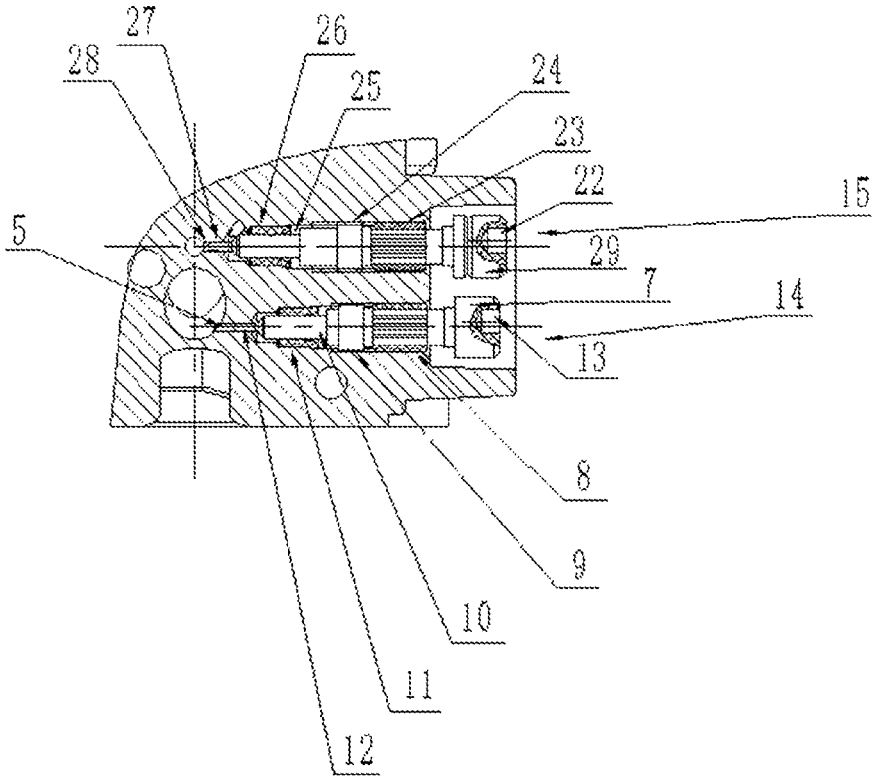
FIG. 4 is a part section view of an installation structure of the high speed adjustment oil needle with eccentric hole and the idle adjustment oil needle with eccentric hole of the embodiment of FIG. 1 in accordance to the present invention.

1 the body; 2 the air and fuel mixing passage; 3 the recess of the body; 4 the fuel inlet; 5 the outlet of the oil passage hole for the high speed adjustment oil needle; 6 the outlet for oil; 7 the head of the high speed adjustment oil needle; 8 the locking portion of the high speed adjustment oil needle; 9 the threaded portion of the high speed adjustment oil needle; 10 a first polished rod portion of the high speed adjustment oil needle; 11 the seal sleeve for the high speed adjustment oil needle; 12 the tip portion of the high speed adjustment oil needle; 13 a first eccentric hole; 14 the high speed adjustment oil needle having eccentric hole; 15 the idle adjustment oil needle having eccentric hole; 16 the pressure pulse chamber; 17 the fuel chamber; 18 the fuel pump diaphragm; 19 the pressure pulse passage; 20 the outlet of the air and fuel mixing passage; 21 the air intake passage; 22 a second eccentric hole; 23 the locking portion of the idle adjustment oil needle; 24 the threaded portion of the idle adjustment oil needle; 25 a first polished rod portion of the idle adjustment oil needle; 26 the seal sleeve for the idle adjustment oil needle; 27 the tip portion of the idle adjustment oil needle; 28 the outlet of the oil passage hole for the idle adjustment oil needle; 29 the head of the idle adjustment oil needle; 30 a first internal threaded portion of the body; 31 the seal sleeve mounting hole for the high speed adjustment oil needle; 32 the oil passage cavity for the high speed adjustment oil needle; 33 the mounting hole for the high speed adjustment oil needle; 34 the mounting hole for the idle adjustment oil needle; 35 a second internal threaded portion of the body; 36 the seal sleeve mounting hole for the idle adjustment oil needle; 37 the oil passage cavity for the idle adjustment oil needle; 38 an inner hole; 39 the handle; 40 the head; 41 the counterbore; 42 an eccentric convex platform; 43 a first eccentric convex platform; 44 the high speed adjustment oil needle having eccentric convex platform; 45 the idle adjustment oil needle having eccentric convex platform; 46 a second eccentric convex platform; 47 the eccentric counterbore; 48 a second polished rod portion of the high speed adjustment oil needle; 49 a second polished rod portion of the idle adjustment oil needle; 50 a polished rod portion of the seal sleeve; 51 the concentric blind hole; 52 the pump cover.

DETAILED DESCRIPTION OF THE INVENTION

In order to understand the invention better and clearly, detail description with examples could be made. But, the present invention will be apparent various changes and modifications without exceeding the broader spirit and scope of the invention as defined by claims. However, the following examples are just used to explain, and not limit the invention.

Example 1

As shown in FIGS. 1-12, an anti-adjusting butterfly valve type carburetor, comprising a body 1, the body 1 is provided with a mounting hole for the high speed adjustment oil needle 33 and a mounting hole for the idle adjustment oil needle 34, a high speed adjustment oil needle having eccentric hole 14 is installed inside the mounting hole for the high speed adjustment oil needle 33 of the body, the high speed adjustment oil needle having eccentric hole 14 comprising a head of the high speed adjustment oil needle 7, an end face of the head of the high speed adjustment oil needle is provided with a first eccentric hole 13, an idle adjustment oil needle having eccentric hole 15 is installed inside the mounting hole for the idle adjustment oil needle 34 of the body, the idle adjustment oil needle having eccentric hole 15 comprising a head of the idle adjustment oil needle 29, an end face of the head of the idle adjustment oil needle 29 is provided with a second eccentric hole 22, the body 1 is provided with an air intake passage 21, an air and fuel mixing passage 2 and an outlet of the air and fuel mixing passage 20, the front end of the mounting hole for the high speed adjustment oil needle 33 is provided with a recess of the body 3, and the front end of the mounting hole for the idle adjustment oil needle 34 is also provided with a recess of the body 3, a pump cover 52 is installed on the upper part of the body 1, a fuel pump diaphragm 18 is installed between the fitting surface of the body 1 and the fitting surface of the pump cover 52, the lower end face of the pump cover 52 is provided with a first recess, a fuel chamber is formed by a cavity enclosed by the first recess and the fuel pump diaphragm 18, the upper end face of the body 1 is provided with a second recess, a pressure pulse chamber 16 is formed by a cavity enclosed by the second recess and the fuel pump diaphragm 18, the body 1 is also provided with a pressure pulse passage 19, the pressure pulse passage 19 is communicated with the pressure pulse chamber 16, the mounting hole for the high speed adjustment oil needle 33 extends from the recess of the body toward inside of the body 1 and it is also successively provided with a first internal thread of the body 30, a seal sleeve mounting hole for the high speed adjustment oil needle 31, an oil passage cavity for the high speed adjustment oil needle 32 and an outlet of the oil passage hole for the high speed adjustment oil needle 5, the body 1 is provided with a fuel inlet 4, the fuel inlet 4 is communicated with the outlet of the oil passage hole for the high speed adjustment oil needle 5, the mounting hole for the idle adjustment oil needle 34 extends from the recess of the body 3 toward inside of the body 1 and it is also successively provided with a second internal thread portion of the body 35, a seal sleeve mounting hole for the idle adjustment oil needle 36, an oil passage cavity for the idle adjustment oil needle 37 and an outlet of the oil passage hole for the idle adjustment oil needle 28, the high speed adjustment oil needle having eccentric hole 14 extends from a side of the head of the high speed adjustment oil needle 7 and it is also successively provided with a locking portion of the high speed adjustment oil needle 8, a threaded portion of the high speed adjustment oil needle 9, a first polished rod portion of the high speed adjustment oil needle 10 and a tip portion of the high speed adjustment oil needle 12, the head of the high speed adjustment oil needle 7 is provided with the second polished rod portion of the high speed adjustment oil needle 48, The shape of the tip portion of the high speed adjustment oil needle 12 is conical, the idle adjustment oil needle having eccentric hole 15 extends from a side of the head of the idle adjustment oil needle 29 and it is also successively provided with a locking portion of the idle adjustment oil needle 23, a threaded portion of the idle adjustment oil needle 24, a first polished rod portion of the idle adjustment oil needle 25 and a tip portion of the idle adjustment oil needle 27, the head of the idle adjustment oil needle 29 is provided with the second polished rod portion of the idle adjustment oil needle 49, the shape of the tip portion of the idle adjustment oil needle 27 is conical, a seal sleeve for the high speed adjustment oil needle 11 is installed inside the seal sleeve mounting hole for the high speed adjustment oil needle 31, the seal sleeve for the high speed adjustment oil needle 11 is provided with a polished rod portion of the seal sleeve 50 and an inner hole 38, a seal sleeve for the idle adjustment oil needle 26 is installed inside the seal sleeve mounting hole for the idle adjustment oil needle 36, the seal sleeve for the idle adjustment oil needle 26 is provided with a polished rod portion of the seal sleeve 50 and an inner hole 38.

Figure 5:
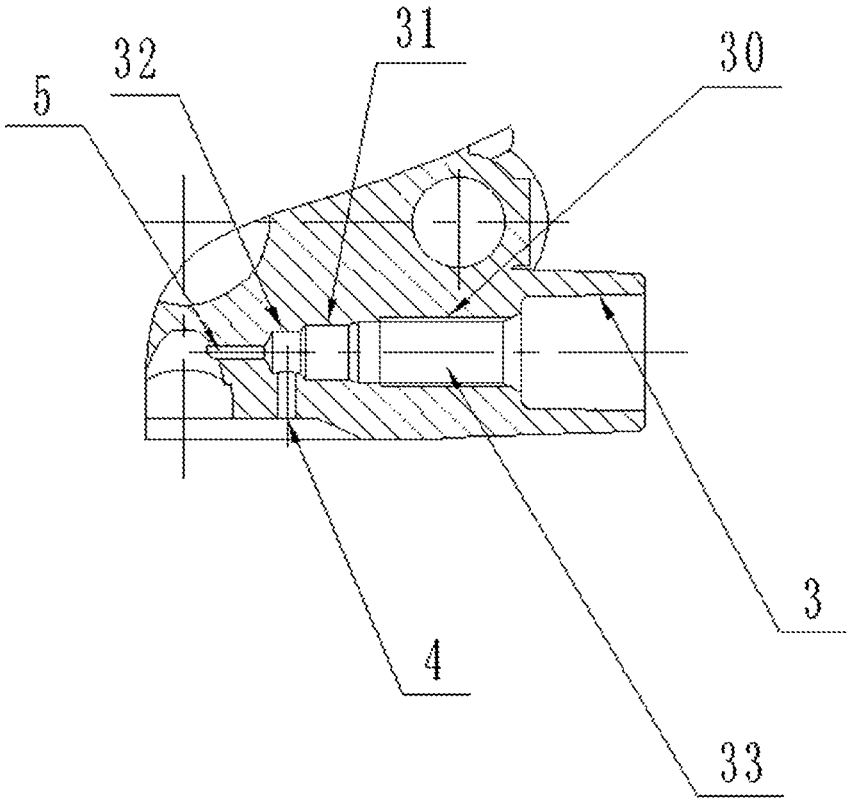
FIG. 5 is a schematic view of a mounting hole of the high speed adjustment oil needle of the embodiment of FIG. 1 in accordance to the present invention.
Figure 7:
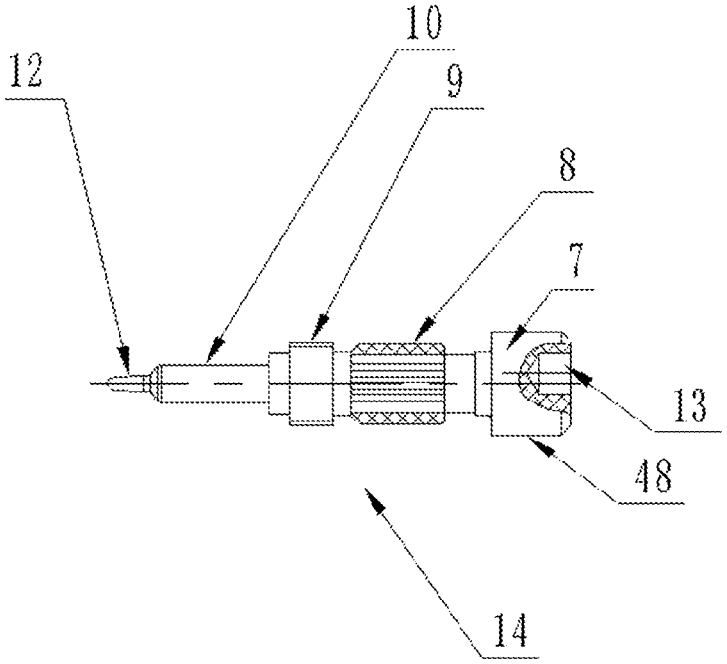
FIG. 7 is a main section view of the high speed adjustment oil needle having eccentric hole of the embodiment of FIG. 1 in accordance to the present invention.
Figure 8:
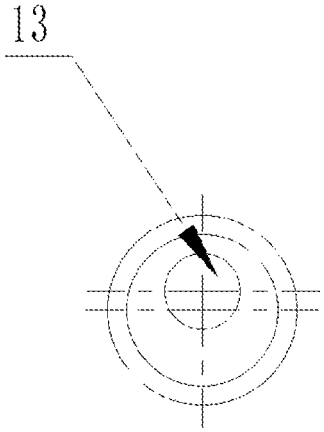
FIG. 8 is a right view of the high speed adjustment oil needle having eccentric hole of the embodiment of FIG. 1 in accordance to the present invention.

As shown in FIGS. 5 and 7, a first internal threaded portion of the body 30 of the mounting hole of the high speed adjustment oil needle 33 is connected with the threaded portion of the high speed adjustment oil needle 9, so the high speed adjustment oil needle having eccentric hole 14 can adjust the oil mass into the engine.

Figure 6:
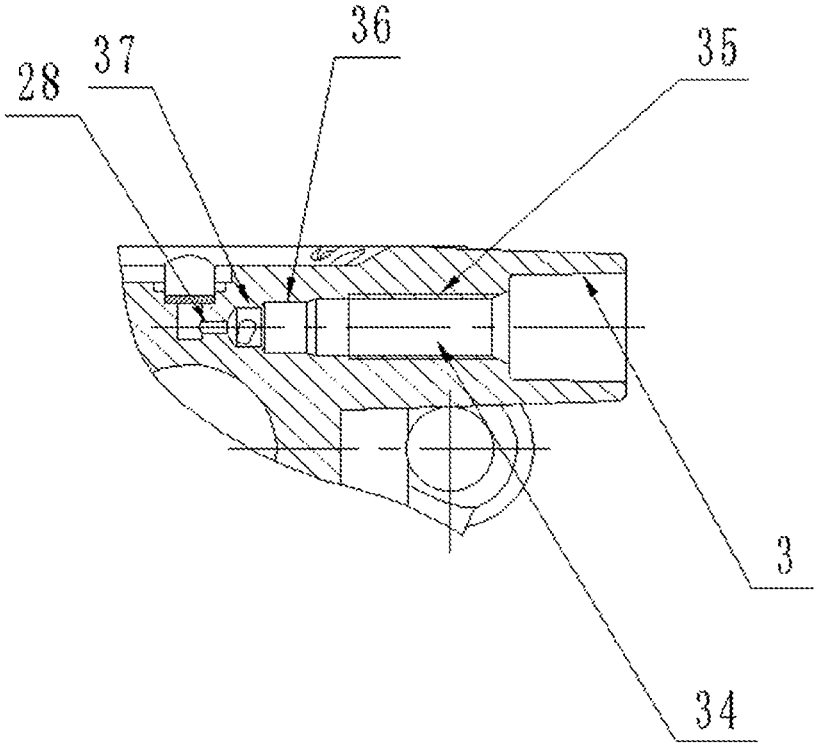
FIG. 6 is a schematic view of a mounting hole of the idle adjustment oil needle of the embodiment of FIG. 1 in accordance to the present invention.
Figure 9:
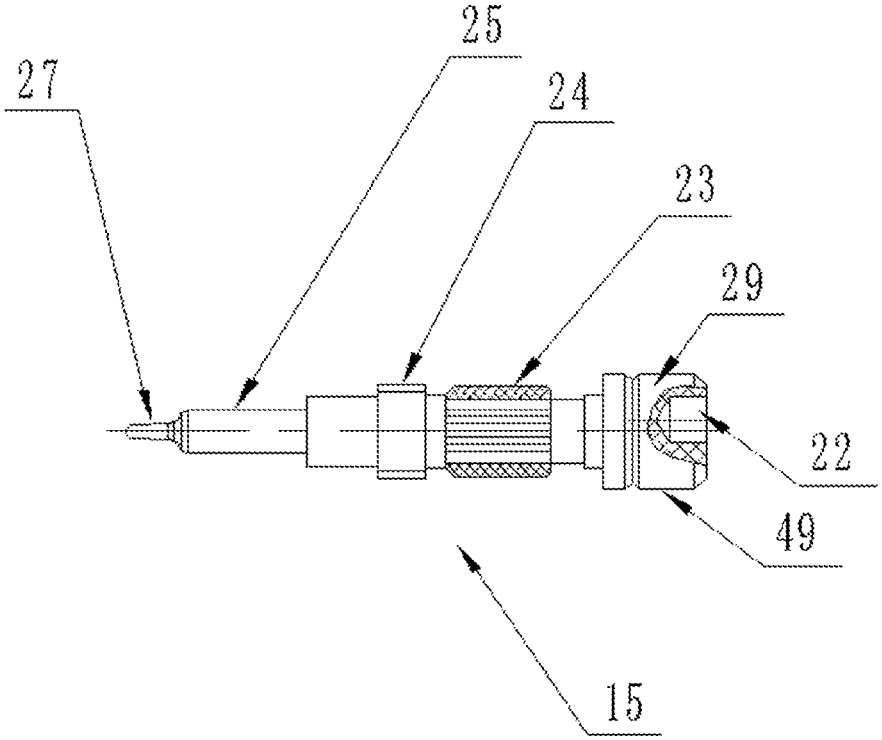
FIG. 9 is a main section view of the idle adjustment oil needle having eccentric hole of the embodiment of FIG. 1 in accordance to the present invention.
Figure 10:
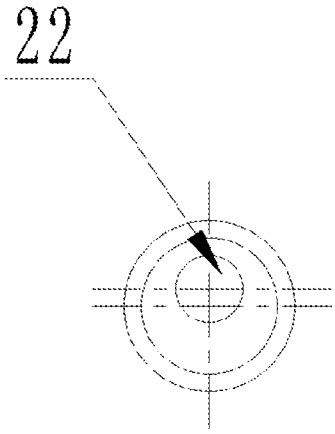
FIG. 10 is a right view of the idle adjustment oil needle having eccentric hole of the embodiment of FIG. 1 in accordance to the present invention.
Figure 11:
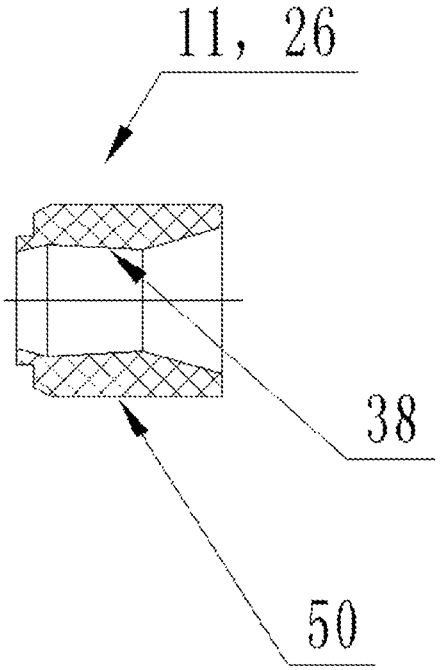
FIG. 11 is a main section view of the seal sleeve of the high speed adjustment oil needle and the seal sleeve of the idle adjustment oil needle of the embodiment of FIG. 1 in accordance to the present invention.
Figure 12:
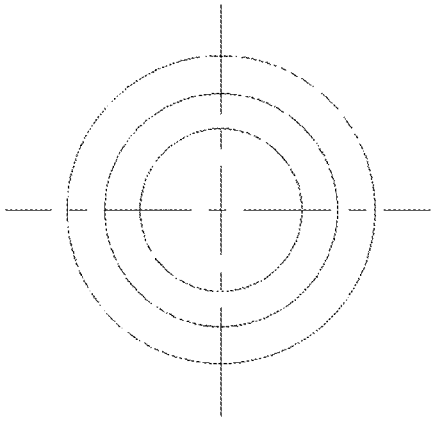
FIG. 12 is a right section view of the seal sleeve of the high speed adjustment oil needle and the seal sleeve of the idle adjustment oil needle of the embodiment of FIG. 1 in accordance to the present invention.

As shown in FIGS. 6 and 9, a second internal threaded portion of the body 35 of the mounting hole of the idle adjustment oil needle 34 is connected with the threaded portion of the idle adjustment oil needle 24, so the idle adjustment oil needle having eccentric hole 15 can adjust the oil mass into the engine.

As shown in FIGS. 4, 5, 7 and 8, the tip portion of the high speed adjustment oil needle 12 matches connection with the outlet of the oil passage hole for the high speed adjustment oil needle 5, this will be for adjusting the oil mass of the anti-adjusting butterfly valve type carburetor, a first polished rod portion of the high speed adjustment oil needle 10 matches connection with the seal sleeve for the high speed adjustment oil needle 11; the locking portion of the high speed adjustment oil needle 8 is interference fitted with the first internal threaded portion of the body 30, to prevent the engine from changing the position of the high speed adjustment oil needle having eccentric hole 14 in the work and to affect the performance of the engine.

As shown in FIGS. 4, 6, 9 and 10, the tip portion of the idle adjustment oil needle 27 matches connection with the outlet of the oil passage hole for the idle adjustment oil needle 28, this will be for adjusting the oil mass of the anti-adjusting butterfly valve type carburetor, the first polished rod portion of the idle adjustment oil needle 25 matches connection with the seal sleeve for the idle adjustment oil needle 26; the locking portion of the idle adjustment oil needle 23 is interference fitted with the second internal threaded portion of the body 35, to prevent the engine from changing the position of the idle adjustment oil needle having eccentric hole 15 in the work and to affect the performance of the engine.

Figure 13:
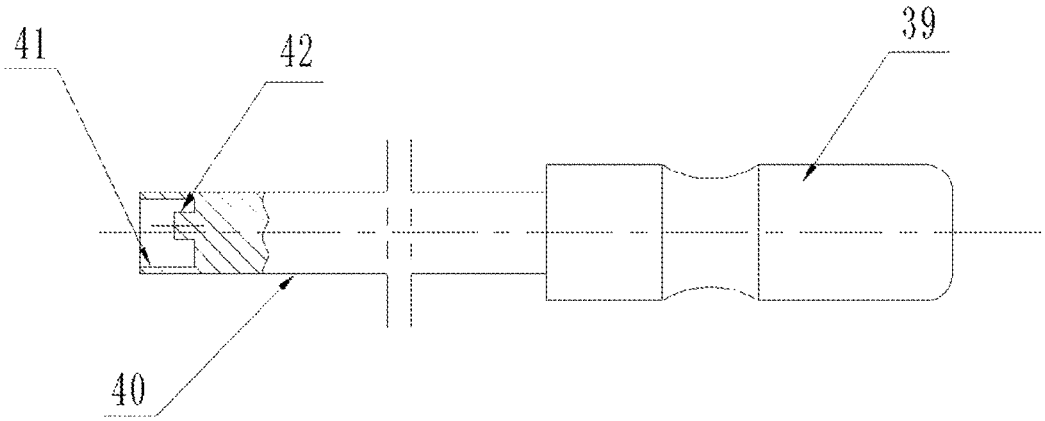
FIG. 13 is a main section view of a specialized adjustment tool for the high speed adjustment oil needle having eccentric hole and the idle adjustment oil needle having eccentric hole of the embodiment of FIG. 1 in accordance to the present invention.
Figure 14:
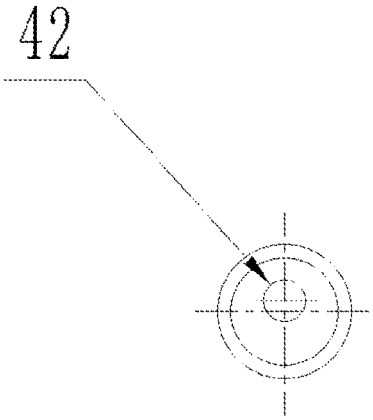
FIG. 14 is a left view of a specialized adjustment tool for the high speed adjustment oil needle having eccentric hole and the idle adjustment oil needle having eccentric hole of the embodiment of FIG. 1 in accordance to the present invention.
Figure 15:
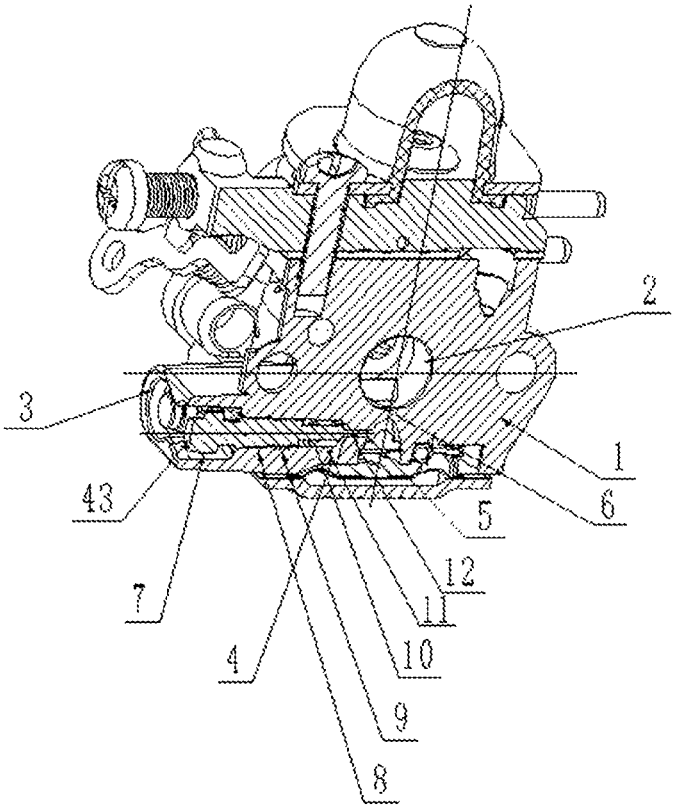
FIG. 15 is an axonometric section view of an optimal embodiment in accordance to the present invention, in which the adjustment oil needles is a high speed adjustment oil needle with eccentric convex platform and an idle adjustment oil needle with eccentric convex platform.
Figure 16:
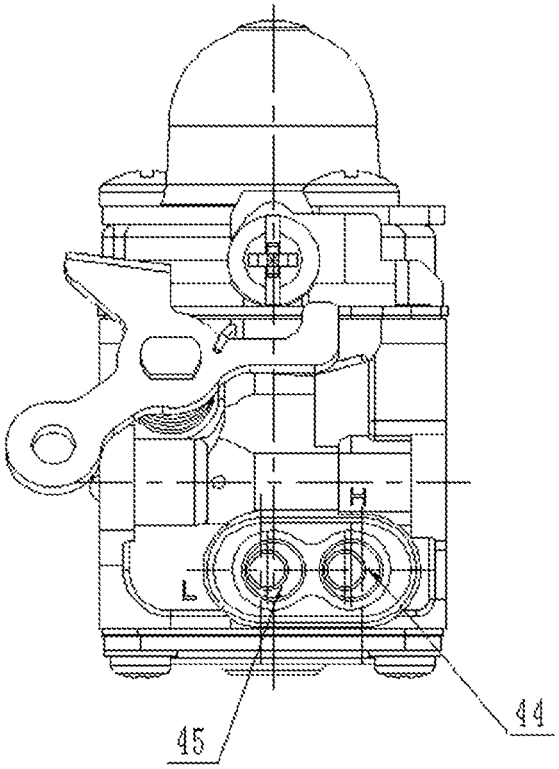
FIG. 16 is a left view of the embodiment of FIG. 15 in accordance to the present invention, in which the adjustment oil needles is a high speed adjustment oil needle with eccentric convex platform and an idle adjustment oil needle with an eccentric convex platform.

As shown in FIGS. 4, 7, 9, 11 and 12, the inner hole 38 match connection with the first polished rod portion of the high speed adjustment oil needle 10, in order to seal and prevent loosing for the high speed adjustment oil needle having eccentric hole 14; the inner hole 38 match connection with the first polished rod portion of the idle adjustment oil needle 25, in order to seal and prevent loosing for the idle adjustment oil needle having eccentric hole 15;

As shown in FIGS. 13 and 14, a specialized adjustment tool with eccentric convex platform, comprising a handle 39 and a head 40, the front face of the head 40 is provided with a counterbore 41, the bottom surface of the counterbore 41 is provided with an eccentric convex platform 42, the head 40 is provided with a polished rod portion, the eccentric convex platform 42 matches connection respectively with the first eccentric hole 13 of the high speed adjustment oil needle having eccentric hole 14 or the second eccentric hole 22 of the idle adjustment oil needle having eccentric hole 15, for adjusting the high speed adjustment oil needle having eccentric hole 14 or the idle adjustment oil needle having eccentric hole 15.

Example 2

As shown in FIGS. 15-21, an anti-adjusting butterfly valve type carburetor that is similar to that in Example 1, and the differences are:

the high speed adjustment oil needle having eccentric convex platform 44 is installed inside the mounting hole for the high speed adjustment oil needle 33 of the body, the high speed adjustment oil needle having eccentric convex platform 44 comprising a head of the high speed adjustment oil needle 7, the head of the high speed adjustment oil needle 7 is provided with a first eccentric convex platform 43, the idle adjustment oil needle having eccentric convex platform 45 is installed inside the mounting hole for the idle adjustment oil needle 34, the idle adjustment oil needle having eccentric convex platform 45 comprising a head of the idle adjustment oil needle 29, the head of the idle adjustment oil needle 29 is provided with a second eccentric convex platform 46, the high speed adjustment oil needle having eccentric convex platform 44 extends from a side of the head of the high speed adjustment oil needle 7 and it is also successively provided with a locking portion of the high speed adjustment oil needle 8, a threaded portion of the high speed adjustment oil needle 9, a first polished rod portion of the high speed adjustment oil needle 10 and a tip portion of the high speed adjustment oil needle 12, the head of the high speed adjustment oil needle 7 is provided with a second polished rod portion of the high speed adjustment oil needle 48, the shape of the tip portion of the high speed adjustment oil needle 12 is conical, the idle adjustment oil needle having eccentric convex platform 45 extends from a side of the head of the idle adjustment oil needle 29 and it is also successively provided with a locking portion of the idle adjustment oil needle 23, a threaded portion of the idle adjustment oil needle 24, a first polished rod portion of the idle adjustment oil needle 25 and a tip portion of the idle adjustment oil needle 27, the head of the idle adjustment oil needle 29 is provided with a second polished rod portion of the idle adjustment oil needle 49, the shape of the tip portion of the idle adjustment oil needle 27 is conical.

As shown in FIGS. 5 and 17-19, a first internal threaded portion of the body 30 of the mounting hole of the high speed adjustment oil needle 33 is connected with the threaded portion of the high speed adjustment oil needle 9, so the high speed adjustment oil needle having the eccentric convex platform 44 can adjust the oil mass into the engine.

As shown in FIGS. 6, 17, 20 and 21, a second internal threaded portion of the body 35 of the mounting hole of the idle adjustment oil needle 34 is connected with the threaded portion of the idle adjustment oil needle 24, so the idle adjustment oil needle having eccentric convex platform 45 can adjust the oil mass into the engine.

As shown in FIGS. 5 and 17-19, the tip portion of the high speed adjustment oil needle 12 matches connection with the outlet of the oil passage hole for the high speed adjustment oil needle 5, this will be for adjusting the oil mass of the anti-adjusting butterfly valve type carburetor, a first polished rod portion of the high speed adjustment oil needle 10 matches connection with a seal sleeve for the high speed adjustment oil needle 11; the locking portion of the high speed adjustment oil needle 8 is interference fitted with the first internal threaded portion of the body 30, to prevent the engine from changing the position of the high speed adjustment oil needle having eccentric convex platform 44 in the work and to affect the performance of the engine.

Figure 17:
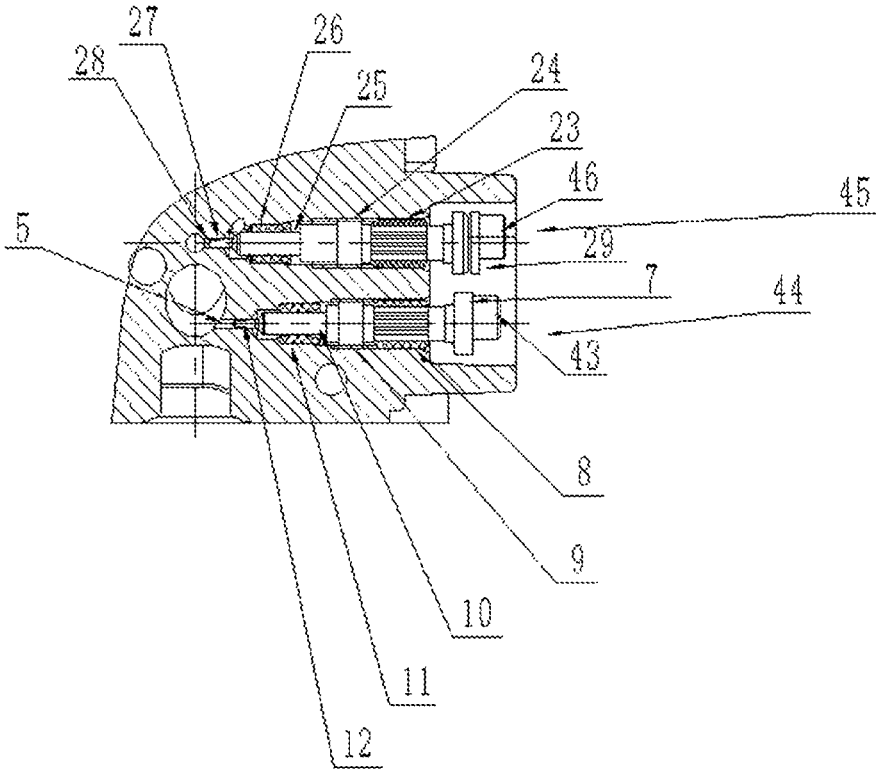
FIG. 17 is a part section view of an installation structure of the high speed adjustment oil needle with eccentric convex platform and the idle adjustment oil needle with eccentric convex platform of the embodiment of FIG. 15 in accordance to the present invention.
Figure 18:
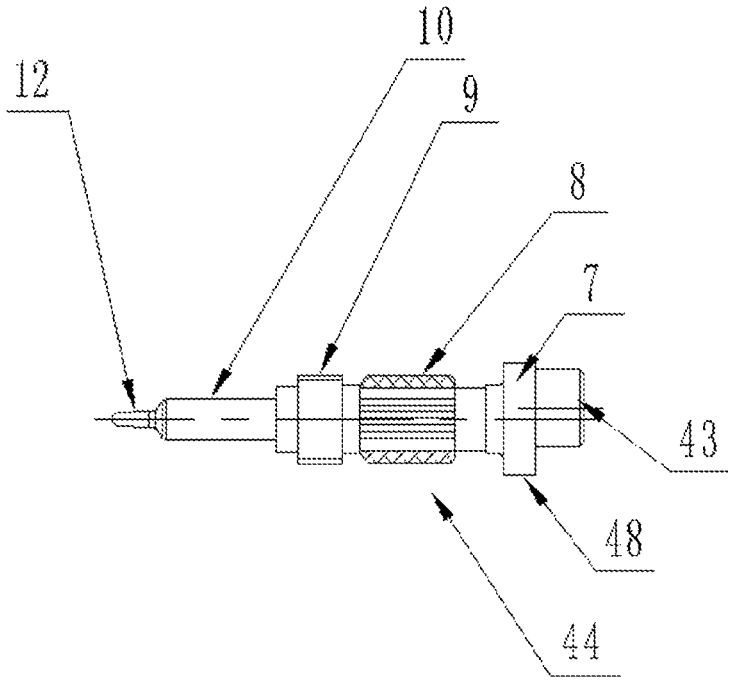
FIG. 18 is a main section view of the high speed adjustment oil needle having eccentric convex platform of the embodiment of FIG. 15 in accordance to the present invention.
Figure 19:
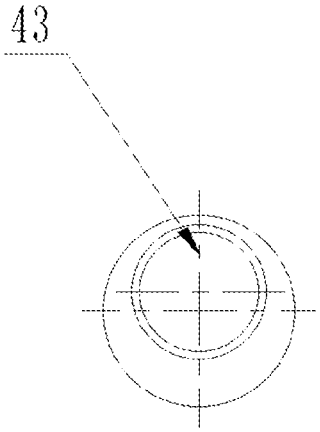
FIG. 19 is a right view of the high speed adjustment oil needle having eccentric convex platform of the embodiment of FIG. 15 in accordance to the present invention.
Figure 20:
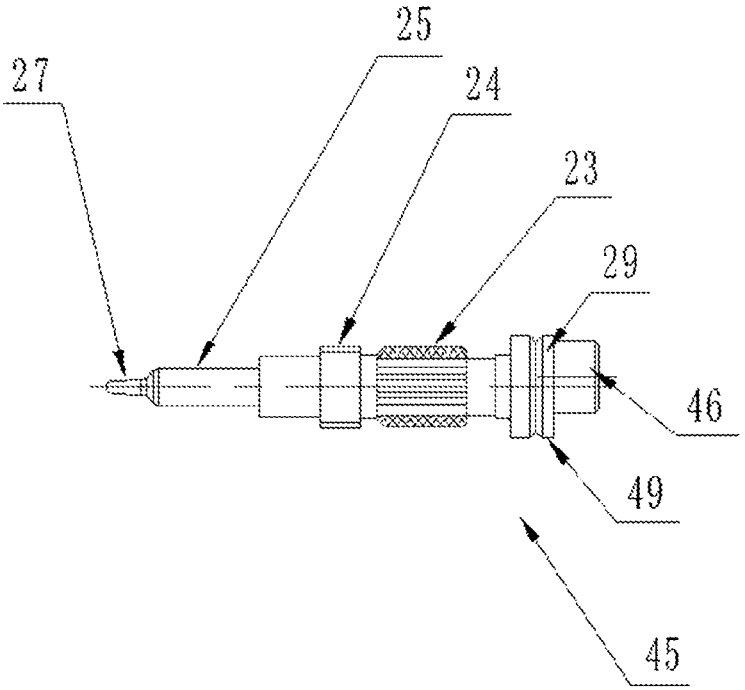
FIG. 20 is a main section view of the idle adjustment oil needle having eccentric convex platform of the embodiment of FIG. 15 in accordance to the present invention.
Figure 21:
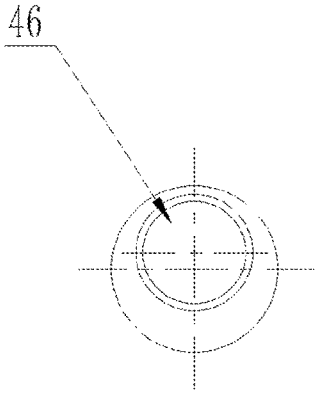
FIG. 21 is a right view of the idle adjustment oil needle having eccentric convex platform of the embodiment of FIG. 15 in accordance to the present invention.

As shown in FIGS. 17 and 20, the tip portion of the idle adjustment oil needle 27 matches connection with the outlet of the oil passage hole for the idle adjustment oil needle 28, this will be for adjusting the oil mass of the anti-adjusting butterfly valve type carburetor, the first polished rod portion of the idle adjustment oil needle 25 matches connection with the seal sleeve for the idle adjustment oil needle 26; the locking portion of the idle adjustment oil needle 23 is interference fitted with the second internal threaded portion of the body 35, to prevent the engine from changing the position of the idle adjustment oil needle having eccentric convex platform 45 in the work and to affect the performance of the engine.

Figure 22:
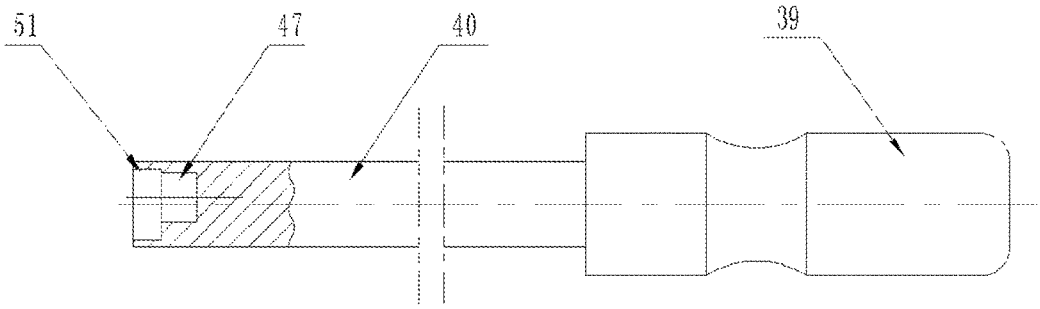
FIG. 22 is a main section view of a specialized adjustment tool for the high speed adjustment oil needle having eccentric convex platform and the idle adjustment oil needle having eccentric convex platform of the embodiment of FIG. 15 in accordance to the present invention.
Figure 23:
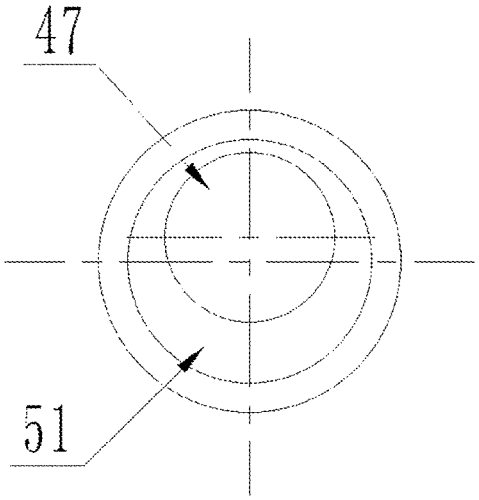
FIG. 23 is a left view of a specialized adjustment tool for the high speed adjustment oil needle having eccentric convex platform and the idle adjustment oil needle having eccentric convex platform of the embodiment of FIG. 15 in accordance to the present invention.

As shown in FIGS. 11, 12, 17, 18 and 20, the inner hole 38 matches connection with the first polished rod portion of the high speed adjustment oil needle 10, in order to seal and prevent loosing for the high speed adjustment oil needle having eccentric convex platform 44; the inner hole 38 matches connection with the first polished rod portion of the idle adjustment oil needle 25, in order to seal and prevent loosing for the idle adjustment oil needle having eccentric convex platform 45;

As shown in FIGS. 22 and 23, a specialized adjustment tool with an eccentric convex platform, comprising a handle 39 and a head 40, the front face of the head 40 is provided with a concentric blind hole 51, the bottom surface of the concentric blind hole 51 is provided with an eccentric counterbore 47, the head 40 is provided with a polished rod portion, the eccentric counterbore 47 matches connection respectively with the first eccentric convex platform 43 of the high speed adjustment oil needle having eccentric convex platform 44 or the second eccentric convex platform 46 of the idle adjustment oil needle having eccentric convex platform 45, for adjusting the high speed adjustment oil needle having eccentric convex platform 44 or the idle adjustment oil needle having eccentric convex platform 45.

What is claimed is:

1. An anti-adjusting butterfly valve type carburetor, comprising a body, the body is provided with an idle adjustment needle mounting hole, wherein an idle adjustment needle having an eccentric hole is installed inside the idle adjustment needle mounting hole of the body, the idle adjustment needle having the eccentric hole comprising a head of the idle adjustment needle, an end face of the head of the idle adjustment needle is provided with a second eccentric hole.

2. A specialized adjustment tool for the anti-adjusting butterfly valve type carburetor of claim 1, comprising a handle and a head, wherein the front face of the head is provided with a counterbore, the bottom surface of the counterbore is provided with an eccentric convex platform.

3. The anti-adjusting butterfly valve type carburetor of claim 1, wherein the body is provided with an air intake passage, an air and fuel mixing passage and an outlet of the air and fuel mixing passage.

4. The anti-adjusting butterfly valve type carburetor of claim 1, wherein the front end of the mounting hole for the idle adjustment needle is provided with a recess of the body.

5. The anti-adjusting butterfly valve type carburetor of claim 1, wherein a pump cover is installed on the upper part of the body, the fuel pump diaphragm is installed between the fitting surface of the body and the fitting surface of the pump cover.

6. The anti-adjusting butterfly valve type carburetor of claim 5, wherein the lower end face of the pump cover is provided with a first recess, a fuel chamber is formed by a cavity enclosed by the fist recess and the fuel pump diaphragm, the upper end face of the body is provided with a second recess, a pressure pulse chamber is formed by a cavity enclosed by the second recess and the fuel pump diaphragm, the body is also provided with a pressure pulse passage, the pressure pulse passage is communicated with the pressure pulse chamber.

7. The anti-adjusting butterfly valve type carburetor of claim 1, wherein the mounting hole for the idle adjustment needle extends from the recess of the body toward inside of the body and it is also successively provided with a second internal thread of the body, a seal sleeve mounting hole for the idle adjustment needle, an passage cavity for the idle adjustment needle and an outlet of the passage hole for the idle adjustment needle.

8. The anti-adjusting butterfly valve type carburetor of claim 1, wherein the idle adjustment needle having eccentric hole extends from a side of the head of the idle adjustment needle and it is also successively provided with locking portion of the idle adjustment needle, threaded portion of the idle adjustment needle, a first polished rod portion of the idle adjustment needle and tip portion of the idle adjustment needle, the head of the idle adjustment needle is provided with a second polished rod portion of the idle adjustment needle.

9. The anti-adjusting butterfly valve type carburetor of claim 8, wherein the shape of the tip portion of the idle adjustment needle is conical.

10. The anti-adjusting butterfly valve type carburetor of claim 7, wherein a seal sleeve for the idle adjustment needle is installed inside the seal sleeve mounting hole for the idle adjustment needle.

11. The anti-adjusting butterfly valve type carburetor of claim 10, wherein the seal sleeve for the idle adjustment needle is provided with a polished rod portion of the seal sleeve and an inner hole.

12. A specialized adjustment tool for the anti-adjusting butterfly valve type carburetor of claim 3, wherein the head is provided with polished rod portion.

13. A specialized adjustment tool for the anti-adjusting butterfly valve type carburetor of claim 1, comprising a handle and a head, wherein the front face of the head is provided with a counterbore, the bottom surface of the counterbore is provided with an eccentric convex platform.

14. The anti-adjusting butterfly valve type carburetor of claim 1, wherein the body is provided with an air intake passage, an air and fuel mixing passage and an outlet of the air and fuel mixing passage.

15. The anti-adjusting butterfly valve type carburetor of claim 1, wherein a pump cover is installed on the upper part of the body, the fuel pump diaphragm is installed between the fitting surface of the body and the fitting surface of the pump cover.

16. The anti-adjusting butterfly valve type carburetor of claim 15, wherein the lower end face of the pump cover is provided with a first recess, a fuel chamber is formed by a cavity enclosed by the fist recess and the fuel pump diaphragm, the upper end face of the body is provided with a second recess, a pressure pulse chamber is formed by a cavity enclosed by the second recess and the fuel pump diaphragm, the body is also provided with a pressure pulse passage, the pressure pulse passage is communicated with the pressure pulse chamber.

17. A specialized adjustment tool for the anti-adjusting butterfly valve type carburetor of claim 13, wherein the head is provided with polished rod portion.

18. An anti-adjusting butterfly valve type carburetor, comprising a body, the body is provided with a idle adjustment needle mounting hole, wherein an idle adjustment needle having eccentric convex platform is installed inside the idle adjustment needle mounting hole of the body, the idle adjustment needle having eccentric convex platform comprising a head of the idle adjustment needle, the head of the idle adjustment needle is provided with a second eccentric convex platform.

19. A specialized adjustment tool for the anti-adjusting butterfly valve type carburetor of claim 18, comprising a handle and a head, wherein the front face of the head is provided with a concentric blind hole, the bottom surface of the concentric blind hole is provided with an eccentric counterbore.

20. The anti-adjusting butterfly valve type carburetor of claim 18, wherein the idle adjustment needle having eccentric convex platform extends from a side of the head of the idle adjustment needle and it is also successively provided with locking portion of the idle adjustment needle, threaded portion of the idle adjustment needle, a first polished rod portion of the idle adjustment needle and tip portion of the idle adjustment needle, the head of the idle adjustment needle is provided with a second polished rod portion of the idle adjustment needle.

21. The anti-adjusting butterfly valve type carburetor of claim 20, wherein the shape of the tip portion of the idle adjustment needle is conical.

22. A specialized adjustment tool for the anti-adjusting butterfly valve type carburetor of claim 19, wherein the head is provided with polished rod portion.

23. A specialized adjustment tool for the anti-adjusting butterfly valve type carburetor of claim 18, comprising a handle and a head, wherein the front face of the head is provided with a concentric blind hole, the bottom surface of the concentric blind hole is provided with an eccentric counterbore.

24. The anti-adjusting butterfly valve type carburetor of claim 18, wherein the body is provided with an air intake passage, an air and fuel mixing passage and an outlet of the air and fuel mixing passage.

25. The anti-adjusting butterfly valve type carburetor of claim 18, wherein the front end of the mounting hole for the idle adjustment needle is provided with a recess of the body.

26. The anti-adjusting butterfly valve type carburetor of claim 18, wherein a pump cover is installed on the upper part of the body, the fuel pump diaphragm is installed between the fitting surface of the body and the fitting surface of the pump cover.

27. The anti-adjusting butterfly valve type carburetor of claim 26, wherein the lower end face of the pump cover is provided with a first recess, a fuel chamber is formed by a cavity enclosed by the fist recess and the fuel pump diaphragm, the upper end face of the body is provided with a second recess, a pressure pulse chamber is formed by a cavity enclosed by the second recess and the fuel pump diaphragm, the body is also provided with a pressure pulse passage, the pressure pulse passage is communicated with the pressure pulse chamber.

28. The anti-adjusting butterfly valve type carburetor of claim 18, wherein the mounting hole for the idle adjustment needle extends from the recess of the body toward inside of the body and it is also successively provided with a second internal thread of the body, a seal sleeve mounting hole for the idle adjustment needle, an passage cavity for the idle adjustment needle and an outlet of the passage hole for the idle adjustment needle.

29. The anti-adjusting butterfly valve type carburetor of claim 28, wherein a seal sleeve for the idle adjustment needle is installed inside the seal sleeve mounting hole for the idle adjustment needle.

30. The anti-adjusting butterfly valve type carburetor of claim 29, wherein the seal sleeve for the idle adjustment needle is provided with a polished rod portion of the seal sleeve and an inner hole.

31. A specialized adjustment tool for the anti-adjusting butterfly valve type carburetor of claim 23, wherein the head is provided with polished rod portion.

* * * * *